US006935390B2

(12) United States Patent
Williamson

(10) Patent No.: US 6,935,390 B2
(45) **Date of Patent: *Aug. 30, 2005**

(54) METHOD AND APPARATUS FOR PROVIDING FLUID TRANSFER BETWEEN A MARINE PLATFORM AND A SERVICE VESSEL

(76) Inventor: John P. Williamson, 3025 Roderick St., Morgan City, LA (US) 70380

( * ) Notice: Subject to any disclaimer, the term of this patent is extended or adjusted under 35 U.S.C. 154(b) by 0 days.

This patent is subject to a terminal disclaimer.

(21) Appl. No.: 10/441,134

(22) Filed: May 19, 2003

(65) Prior Publication Data

US 2004/0069374 A1 Apr. 15, 2004

Related U.S. Application Data

(63) Continuation-in-part of application No. 10/083,193, filed on Feb. 26, 2002, now Pat. No. 6,609,544.

(51) Int. Cl.[7] ..... B65B 1/04

(52) U.S. Cl. ..... 141/387; 441/5; 114/230.1

(58) Field of Search ..... 141/387–389; 441/3–6; 114/230.1, 230.15, 230.16, 230.17, 230.18, 230.19; 414/137.9, 138.1, 138.5, 138.7, 138.8

(56) References Cited

U.S. PATENT DOCUMENTS 3,519,034 A 7/1970 Manning
4,396,046 A 8/1983 Kentosh
4,494,475 A 1/1985 Eriksen
4,669,412 A 6/1987 Pollack
6,609,544 B1 * 8/2003 Williamson ..... 141/387

* cited by examiner

*Primary Examiner*—Steven O. Douglas
(74) *Attorney, Agent, or Firm*—Garvey, Smith, Nehrbass & Doody, L.L.C.; Charles C. Garvey, Jr.

(57) ABSTRACT

The present invention provides a method and apparatus for fluid transfer between a fixed marine production platform and a work vessel (eg. jack up barge). The method includes positioning the work vessel next to the production platform and then adjusting the elevational position of the vessel relative to the production platform so that the deck of the production platform and the deck of the work vessel or at about the same elevational position. A bridge truss spans between the deck portions of the production platform and work vessel, the truss having interconnected truss members and a planar surface that enables flexible hoses to be supported by the truss. The truss further includes a plurality of piping spool pieces that span across the truss. Ends of the spool pieces have quick connect fittings that enable the spool pieces to be quickly connected to the piping system of the production platform and work vessel. The gap between the production platform and the work vessel are spanned with the truss. Piping systems on the production platform and work vessel are connected to the spool pieces at the quick connect fittings so that fluid transfer is enabled between the production platform and the work vessel via the spool pieces on the truss. An upper tray enables flexible hoses (eq. hydraulic hoses) to span between the work vessel and production platform.

48 Claims, 8 Drawing Sheets

METHOD AND APPARATUS FOR PROVIDING FLUID TRANSFER BETWEEN A MARINE PLATFORM AND A SERVICE VESSEL

CROSS-REFERENCE TO RELATED APPLICATIONS

This is a continuation-in-part of U.S. Ser. No. 10/083,193, filed Feb. 26, 2002 now U.S. Pat. No. 6,609,544.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to maintenance of a fixed, marine production platform, such as an oil and gas production platform. More particularly, the present invention relates to the maintenance of a fixed marine production platform wherein fluid transfer between a fixed marine production platform and a work vessel (eg. jack up barge) is accomplished by spanning the gap between the production platform and work vessel with a truss that is liftable and self supporting, the truss being equipped with multiple fluid transfer pipe spool pieces that have quick connect fittings for coupling to respective piping systems of the marine production platform and the work vessel.

2. General Background

An oil and gas well production platform in a marine environment produces oil and/or gas after drilling is completed. Such platforms are typically fixed to the seabed, but can be floating or semi-submersible and "fixed" to one locale using very large buoys and anchors or GPS driven self propelling system. Because these platforms are "fixed" to a geographic locale that is a site of an oil and/or gas reservoir, they must be serviced and maintained with boats or other work vessels. Maintenance can be carried out by jack up vessels, work boats, tug boats, crew boats or other such floating, mobile equipment.

One such maintenance activity is the transfer of fluid to or from the production platform. Heretofore, such fluid transfer has been accomplished by using flexible rubber or like hoses that drape between production platform and work vessel. During any maintenance activity that necessitates a work vessel, personnel must necessarily travel between the production platform and work vessel.

A very dangerous practice that has evolved is the placement of fluid transfer hoses on a personnel ramp that spans between a production platform and a work vessel. Such a walkway can become wetted with leaking fluid that is being transferred via the hoses. In many cases the fluid being transferred is oil, drilling fluids, drilling mud, well fluids and the like. Many of these fluids are ver viscous and slippery. A worker can easily slip and fall in such a hazardous situation. Danger is compounded because the walkway can be at a lofty elevation if a jack up barge is servicing a fixed platform having a deck that is many feet above the water's surface. Although Federal Agencies (eg. Minerals Management Services or "MMS") have regulations prohibiting such practices, workers forget the regulations during the performance of their jobs and subject themselves to injury or death.

BRIEF SUMMARY OF THE INVENTION

The present invention provides an improved method and apparatus for transferring fluids between a "fixed" production platform and a work vessel such as a jack up barge, work boat, tug, new boat or the like. "Fixed production platform" as used herein means a stationary marine platform that is producing oil and/or gas from an oil and/or gas reservoir beneath a seabed, after a well has been completed. The present invention enables fluid transfer between a production platform and a work vessel in a marine environment.

Fluid transfer is effected using a self supporting liftable truss that can be positioned with a crane or like lifting device. The truss provides multiple fixed pipe spool pieces that span the length of the truss. Each pipe spool piece preferably has end portions with fittings that enable connections to be made to piping systems of the production platform or work vessel. The fittings can be quick connect fittings.

The pipe spool pieces are preferably placed at different elevational positions on the truss. Trays are provided on the truss including an upper tray and a lower tray. The upper tray enables additional flow lines (eg. hoses) to span between the production platform and work vessel for carrying additional fluids. The lower tray can also carry additional flow lines. However, the lower tray is configured to serve as a spill collector for catching and holding fluid that might otherwise pollute the surrounding marine environment.

A feature of the present invention is that the truss does not provide a walkway that might become slippery if coated with leaking fluid.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 5:
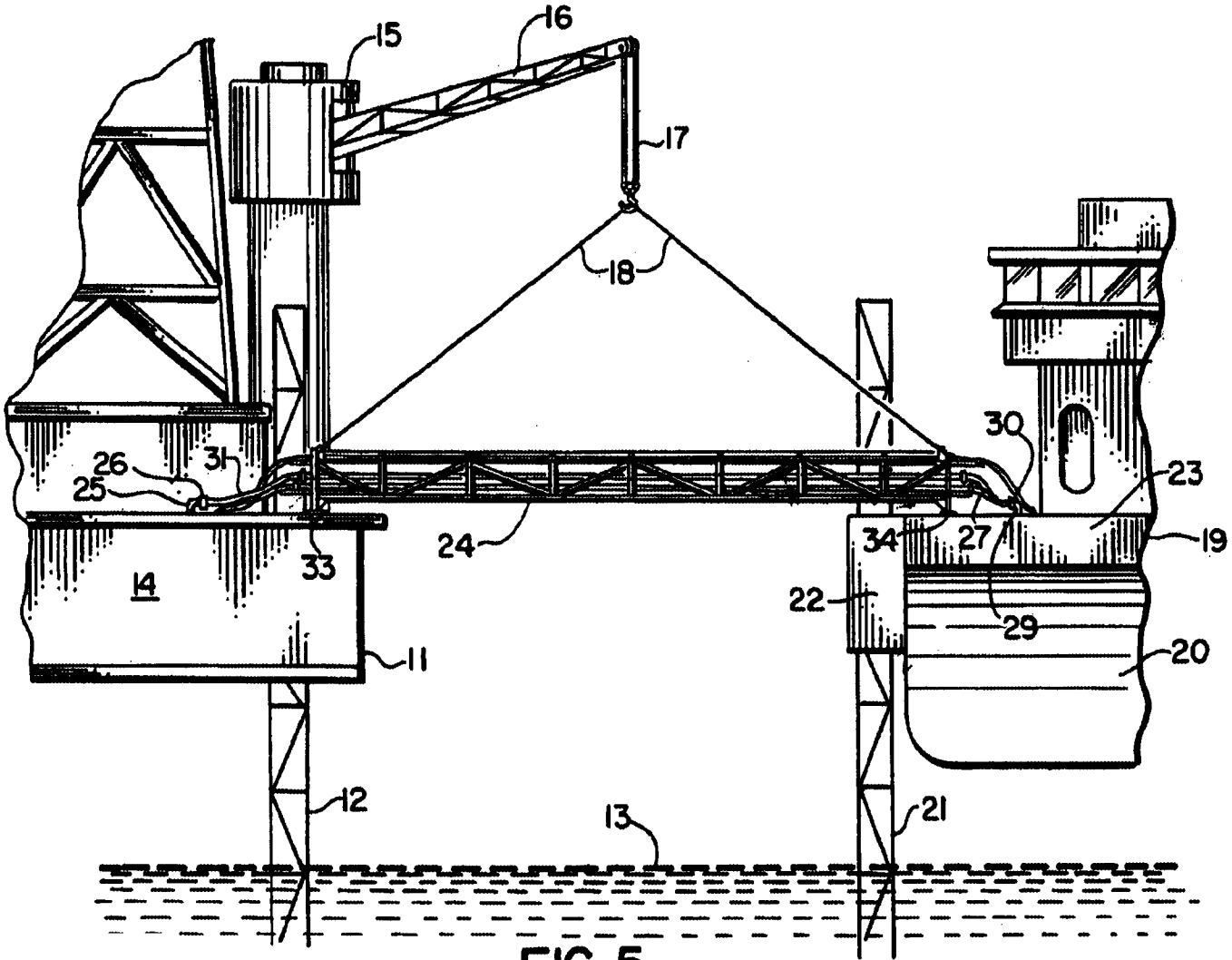
FIG. 5 is a schematic elevation view of the preferred embodiment of the apparatus of the present invention showing the apparatus in use, spanning between a production platform and a service vessel.

The present invention provides an improved method and apparatus for the transfer of fluids between a fixed marine platform 11 and a service vessel or work vessel 19 (see FIG. 5). In FIG. 5, the fixed production platform 11 can be a jack up type production rig, a permanently installed rigid platform mounted upon a jacket, or semi-submersible that is maintained in its position using very large buoys and anchors or a GPS, self propelled system.

The platform 11 can be supported upon legs 12 such as telescoping legs in the case of a jack up rig production platform or the legs 12 can be part of an overall structural jacket that supports a deck 14 at a position that is spaced above the water's surface 13. Such fixed platforms are known in the art and are used commonly in coastal or offshore waters for the production of oil and gas.

In FIG. 5, a lifting device 15 such as a crane can be provided on either the fixed marine production platform 11 or the service vessel 19 in the case of a jack up rig as shown in FIG. 5. Such a lifting device 19 is known in the art and commonly provides an elongated boom 16 having a lifting line 17 and rigging 18 that can include a spreader bar, slings, and the like.

Service vessel 19 can be a work boat, jack up rig, crew boat, or the like. In FIG. 5, the service vessel 19 is a jack up barge having a hull 20, a plurality of telescoping legs 21, and a jacking structure 22 that elevates the hull 20 with respect to the legs 21 and the water surface 13. The hull 11 can provide a deck area 23. As part of the method of the present invention, the deck areas 14, 23 of the respective production platform 11 and service vessel 19 are preferably positioned at a generally common elevational position such as is illustrated in FIG. 5.

The marine production platform 11 has a piping system that is indicated schematically by the numeral 25, being only partially shown for purposes of clarity in FIG. 5. Similarly, the work vessel or service vessel 19 provides a piping system 29 that is only partially illustrated in FIG. 5 for purposes of clarity.

In order to effect fluids transfer between the production platform 11 and the work or service vessel 19, the apparatus 10 of the present invention includes a truss 24 that spans between the deck 14 of production platform 11 and the deck 23 of service vessel 19. The truss 24 is preferably positioned, according to the method of the present invention, using a lifting device 15 that is provided on either the production platform 11 or on a service vessel 19. Lifting device 15 can lift truss 24 with line 18 that attaches to openings 41 of lifting eyes 40 using shackles 57 (see FIGS. 5 and 8).

Once the truss 24 has been placed in a position as shown in FIG. 5 wherein it rests upon the decks 14 of production platform 11 and 23 of service vessel 19, the rigging 18 can be disconnected. A fluid transfer is then perfected by attaching the piping system 25 of the production platform 11 to one end portion of the truss 24 as will be described more fully hereinafter. Likewise, the piping system 29 of the service vessel 19 is coupled to flow lines on the truss 24 as will be described more fully hereinafter.

Figure 1:
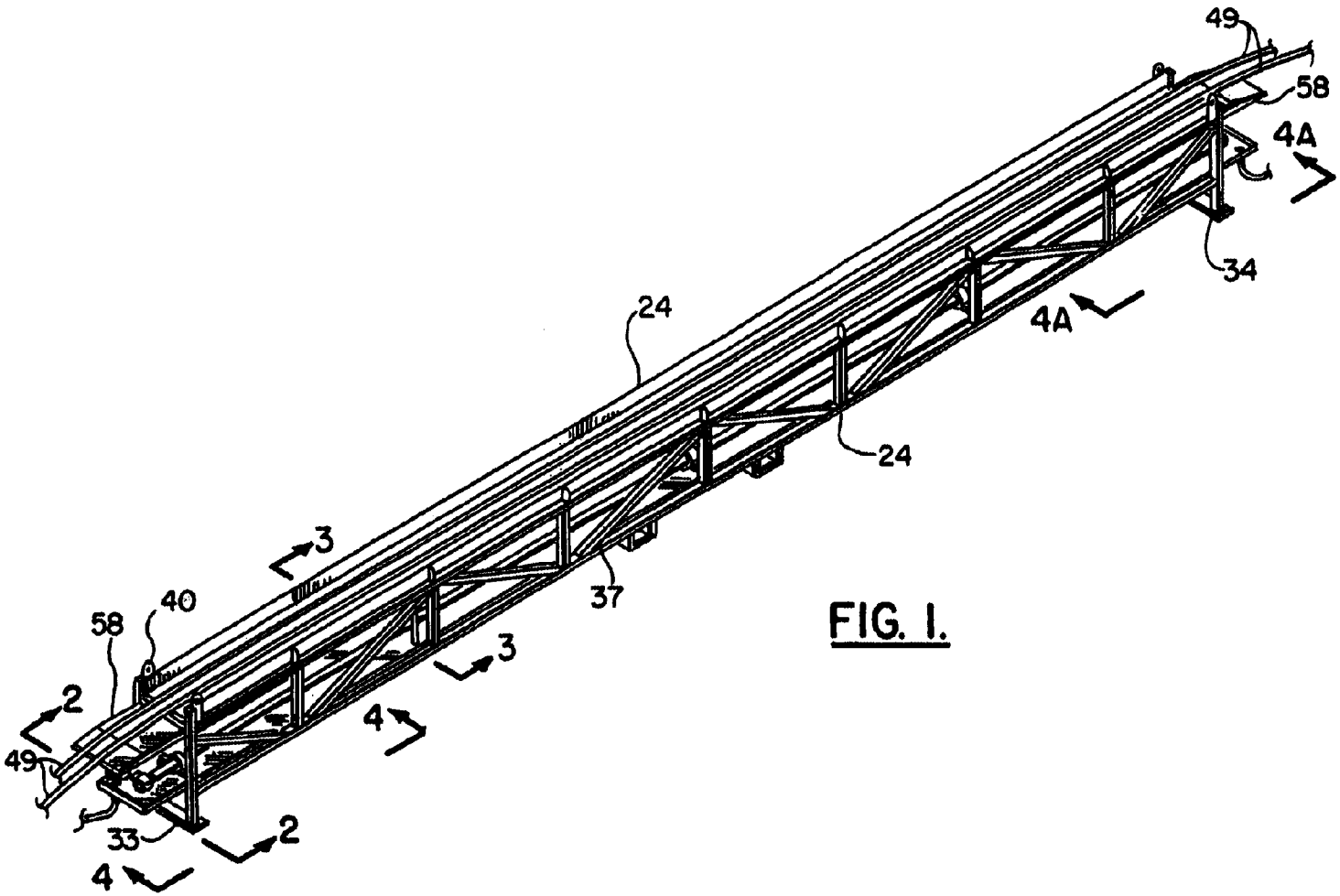
FIG. 1 is a perspective view of the preferred embodiment of the apparatus of the present invention.
Figure 2:
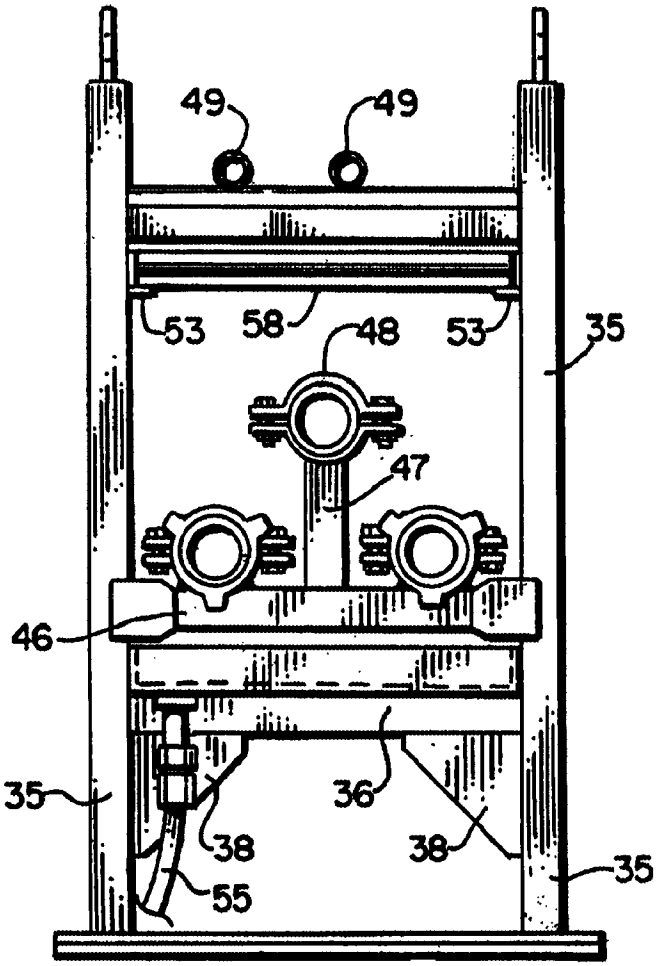
FIG. 2 is a sectional view taken along lines 2—2 of FIG. 1.
Figure 4:
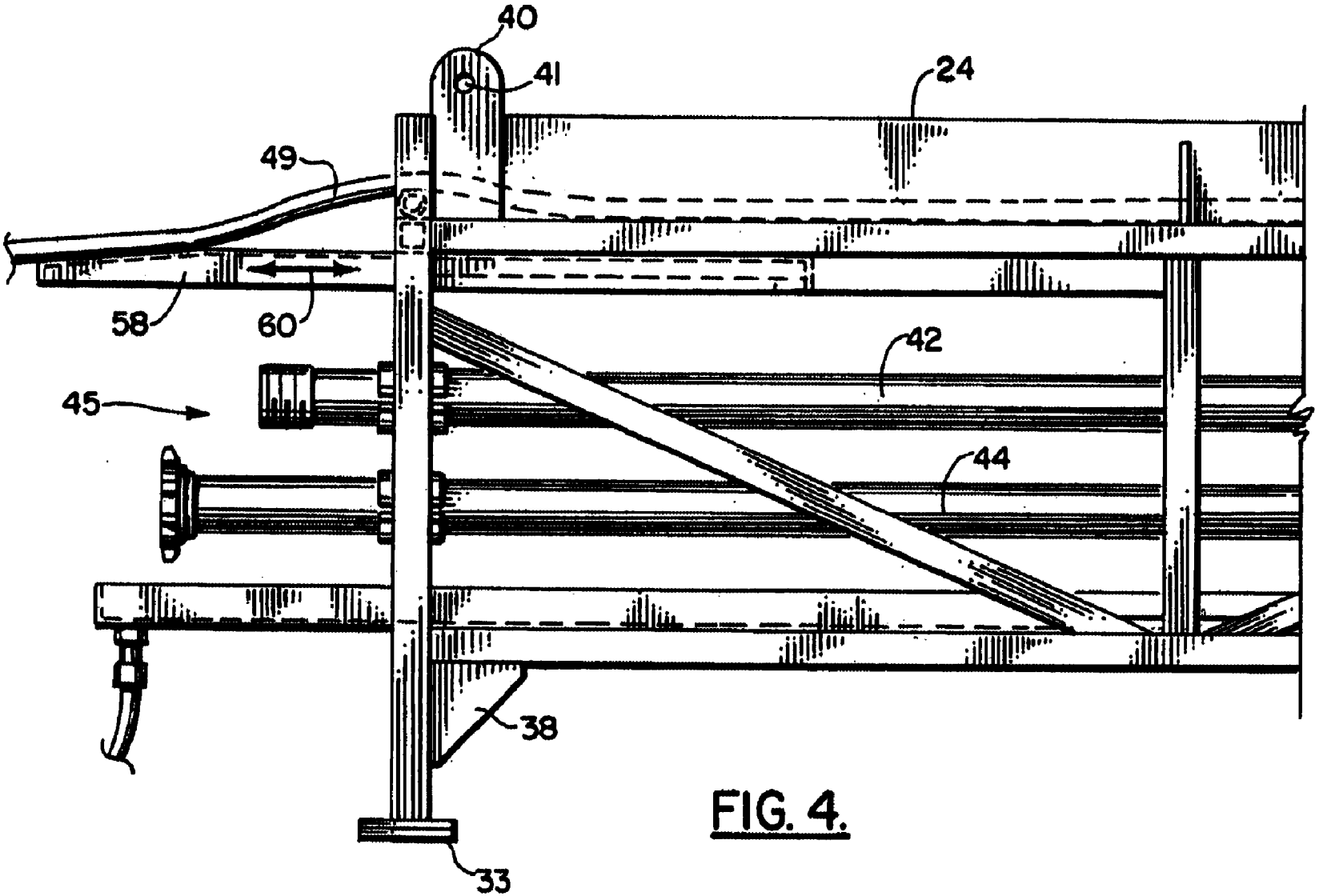
FIG. 4 is a sectional view taken along lines 4—4 of FIG. 1.
Figure 4A:
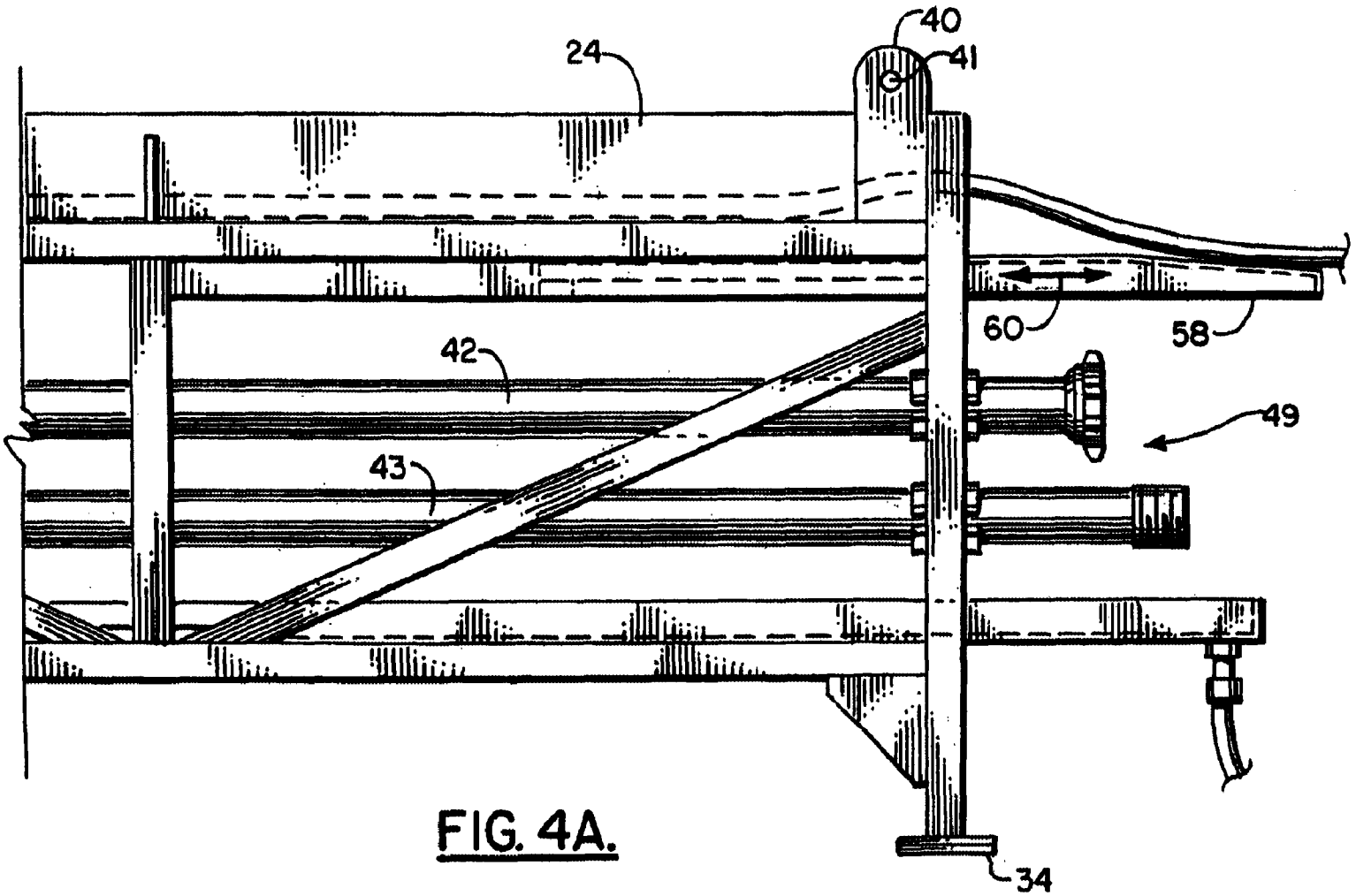
FIG. 4A is a sectional view taken along lines 4*a*—4*a* of FIG. 1.

In FIGS. 1–4*a* and 6, the construction of the truss 24 and its fluid conveying flow lines and hoses is shown more particularly. The truss 24 can be comprised generally of welded steel and includes a plurality of vertical members 35, horizontal members 36, and longitudinal members 37. Truss 24 can also include diagonally extending members. The vertical members 35 have lower end portions that provide feet 33, 34 that rest upon the production platform 11 and work vessel 19 as shown in FIG. 5. In FIGS. 1 and 5, the foot 33 is positioned upon deck 14 of production platform 11. The foot 34 is positioned upon the deck 29 of service vessel 19. Gusset plates 38 can be provided to rigidify the truss 24 as shown in FIG. 2 at the intersection of selected members such as at the intersection of horizontal member 36 with vertical members 35 as shown in FIG. 2.

Figure 3:
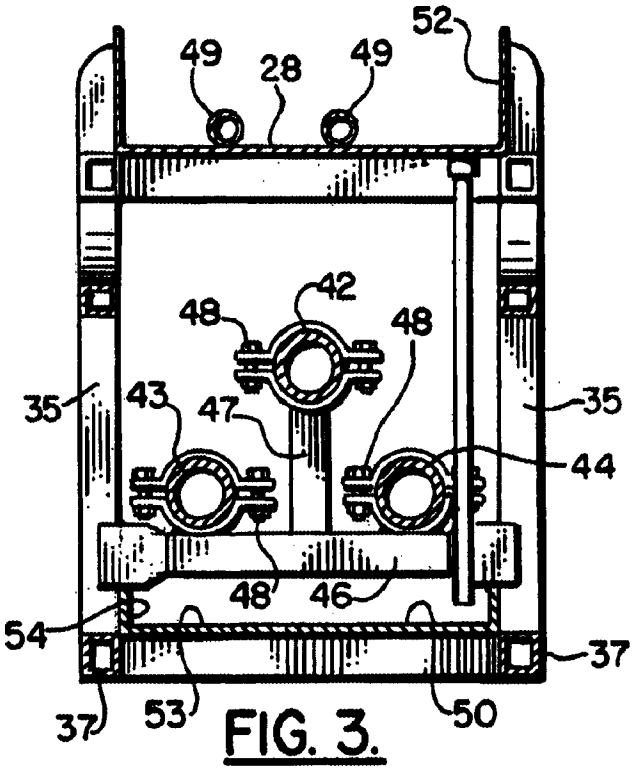
FIG. 3 is a sectional view taken along lines 3—3 of FIG. 1.

The truss 24 provides a plurality of piping spool pieces 42, 43, 44. Any number of piping spool pieces 42, 43, 44 can be provided. In FIGS. 2 and 3, there are three (3) piping spool pieces 42, 43, 44 illustrated. These spool pieces include two lower spool pieces 43, 44 and an upper spool piece 42.

A pipe rack 45 supports each of the spool pieces 42–44. The pipe rack 45 can include a plurality of transverse members 46 that span between vertical members 35 of the truss 24 as shown in FIG. 3 and a vertical member 47 that extends upwardly from each transverse support 46. Pipe clamps 48 are provided to support each spool piece 42, 43, 44 as shown in FIGS. 2 and 3. A pipe clamp 48 is provided at the top of vertical support 47. A pair of pipe clamps 48 are provided on transverse support 46 as shown in FIGS. 2 and 3.

Each spool piece 42–44 has end portions with quick connect couplings 32. Flexible hoses 31 can be used to form a fluid conveying interface between the spool pieces 42–44 and the production platform 11 at one end portion of truss 24 and with service vessel 19 at the opposite end portion of truss 24. The hoses 31 can be quickly connected to or quickly disconnected from the spool pieces 42–44 using couplings 32. The piping system 25 of production platform 14 provides a fitting 26 for connection to the hoses 31 that interface with and connect to the piping spool pieces 42, 43, 44 at couplings 32. Similarly, the service vessel 19 piping system 29 has a fitting 30 that can connect with flexible hoses 27 that form a fluid transfer interface between the piping system 29 of work vessel 19 and the spool pieces 42, 43 44 at couplings 32.

The apparatus 10 of the present invention provides a pair of trays, including an upper tray 28 and a lower tray 50. The upper tray 28 can provide support for additional flow lines, preferably flexible hoses 49 that extend between the marine production platform 11 and service vessel 19. The flow lines carried in the upper tray 28 can be, for example, hydraulic flow lines, control line hoses, etc. The hydraulic flow lines can be used in connection with a coil tubing unit, a snubbing unit or other unit operating in whole or in part with hydraulic fluid. The upper tray 28 provides a bottom 51 and side wall 52 for containing any fluids that might leak from the hoses 49, to prevent pollutants from entering the surrounding marine ecosystem.

At each end of upper tray 28 the truss 24 is provided with a sliding retractable tray extension 58. Each tray extension 58 can be supported upon a pair of spaced apart rails or flanges 59 that allow the extensions to slide upon the truss 24 as indicated by arrows 60 in FIGS. 4 and 4A. The extensions 58 ensure that the hoses 49 supported by upper tray 28 will not drape upon the spool pieces 42, 43, 44.

Figure 6:
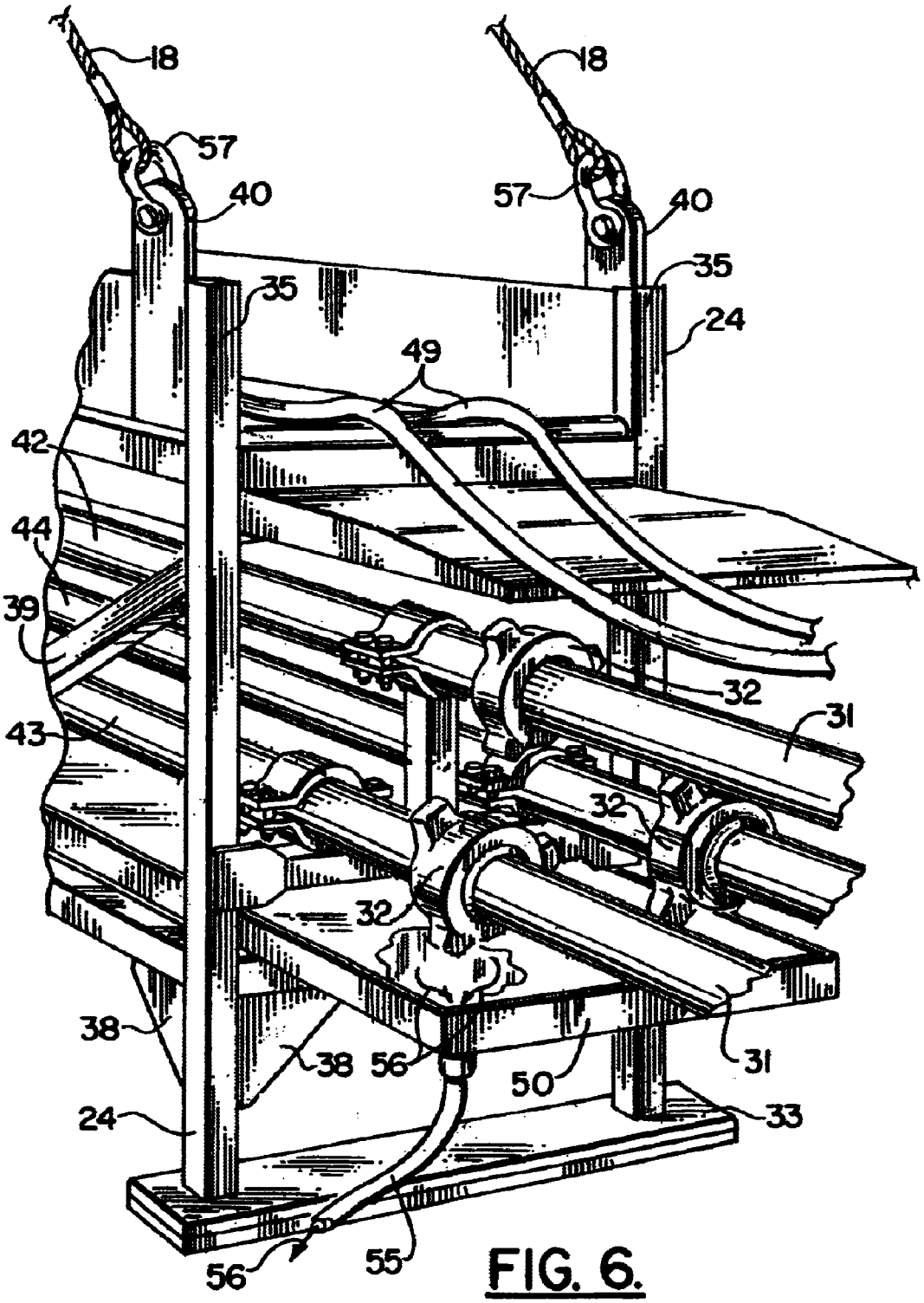
FIG. 6 is a partial perspective view of the preferred embodiment of the apparatus of the present invention.

The lower tray 50 provides a bottom 53 and side wall 54 for containing any fluid that leaks from any one of the piping spool pieces 42, 43, 44. Each of the trays 28, 50 can be provided with a drain flow line 55 for containing and collecting any spilled fluids as illustrated by the arrows 56 in FIG. 6. The apparatus 24 can be provided with a plurality of lifting eyes or padeyes 40 having openings 41, preferably a pair of padeyes 40 at each end portion of truss 24 as shown in FIGS. 5 and 6. The padeyes 40 enable rigging 18 to be attached to the padeyes 40. The rigging 18 can includes slings, shackles 57, spreader bars or the like for enabling the lifting device 15 to lift the truss 24 into position and out of position after a job is completed. The quick neck fittings 32 are disconnected from flexible hoses 31 after a job is completed and fluid transfer has been complete.

Figure 7:
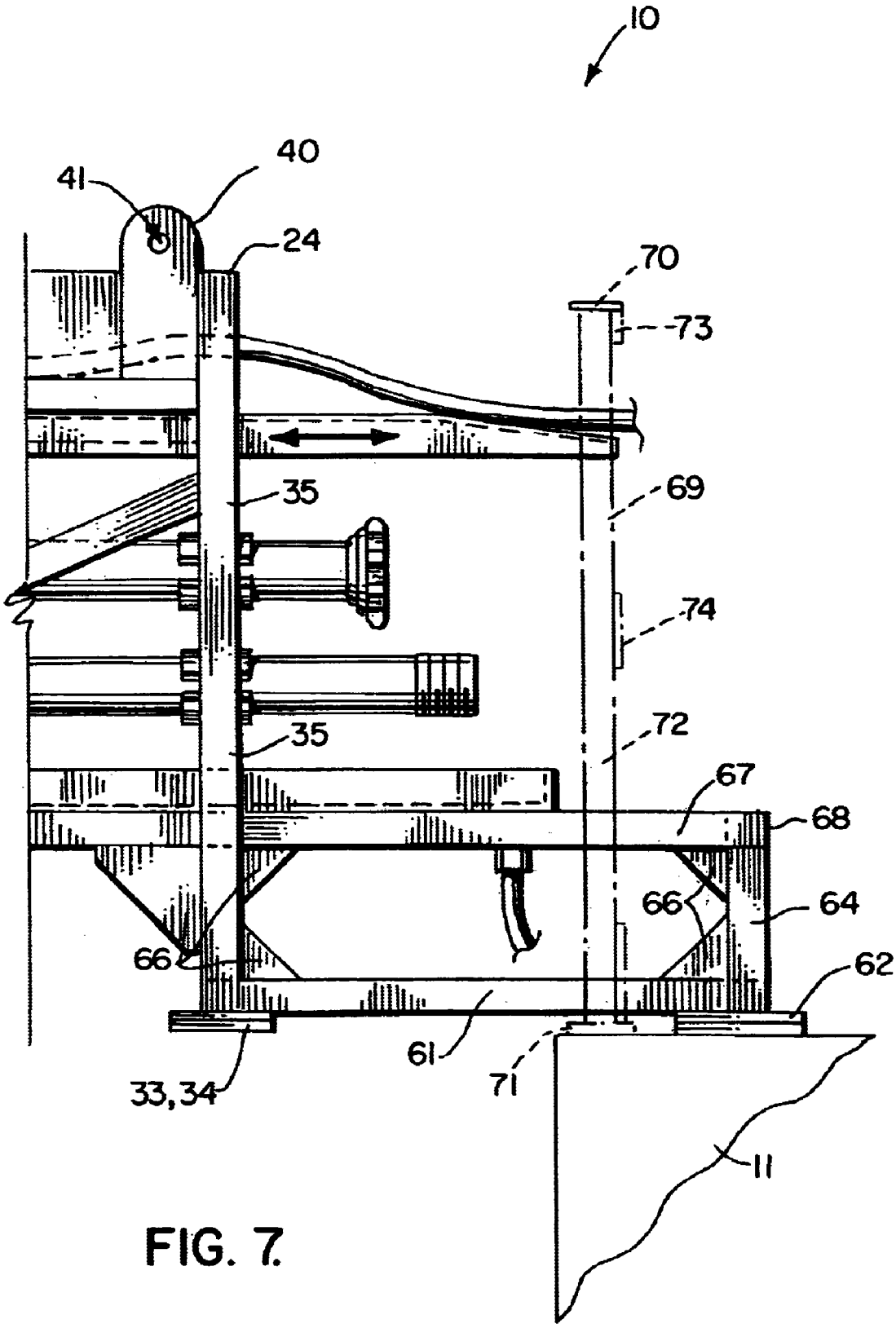
FIG. 7 is a side sectional view of the preferred embodiment of the apparatus of the present invention showing an alternate foot arrangement.
Figure 8:
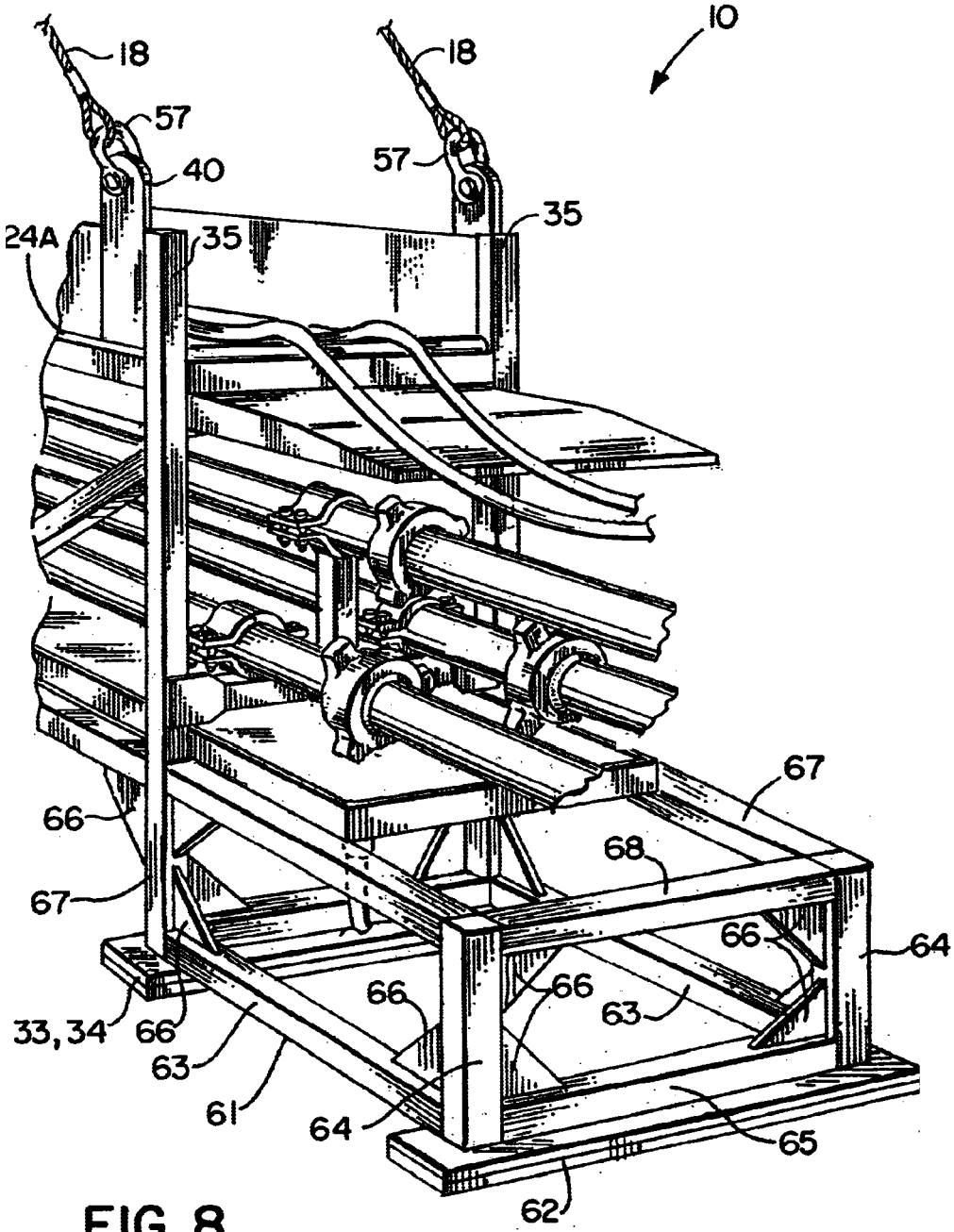
FIG. 8 is a partial perspective view of the preferred embodiment of the apparatus of the present invention showing an alternate foot arrangement.

In FIGS. 7 and 8, the preferred embodiment of the apparatus of the present invention is shown fitted with a foot extension 61. This foot extension 61 can be used in situations wherein the platform 11 (or service vessel 19) has a guard rail 69 that prevents placement of foot 33 or 34 on the deck area 14 of the platform 11 or on the deck 23, hull or upper surface of the hull of the service vessel 19. In situations wherein a guard rail 69 is part of either the platform 11 or service vessel 19 as shown in FIG. 7, the foot extension 61 can extend under any horizontal member 73 of the guard rail 69 as shown in FIG. 7.

In FIGS. 7 and 8, foot extension 61 provides a second foot 62 that is in addition to the foot 33 or 34 at opposing end portions of truss 24 as shown on FIGS. 1–6. Attaching the second foot 62 to truss 24 are a plurality of beams, including lower horizontal beams 63, vertical beams 64, and lower transverse beams 65. Extending from upper transverse beams 68 to vertical members 35 of truss 24 are a pair of spaced apart upper horizontal beams 67. Gusset plates 66 can be used to brace the connections between upper horizontal members 67 and vertical members 35 as well as connections between vertical beams 64 and horizontal members 63, 65, 67, 68.

FIG. 7 shows a typical guard rail 69 having an upper end portion 70, lower end portion 71 that is attached to platform 11 or service vessel 19. The guard rail 69 typically has a plurality of spaced apart vertical members or posts 72 that are spanned by an upper horizontal member 73 and lower horizontal members 74. In FIG. 7, the extension 61 fits under one of the lower horizontal members 74 and in between two of the vertical members or posts 72 as shown in FIG. 7.

The apparatus and method of the present invention can be used to transfer any number of fluids between a production platform 11 and a work vessel or service vessel 19 including but not limited to chemicals, diesel fuel, seawater, oil, liquid drilling fluid, liquid drilling mud, acids, gases (eg. nitrogen), and water.

Parts List

The following is a list of suitable parts and materials for the various elements of the preferred embodiment of the present invention.

| PART NUMBER | DESCRIPTION |
|---|---|
| 10 | fluids transfer bridge |
| 11 | marine production platform |
| 12 | leg |
| 13 | water surface |
| 14 | deck |
| 15 | lifting device |
| 16 | boom |
| 17 | lift line |
| 18 | rigging |
| 19 | service vessel |
| 20 | hull |
| 21 | telescoping leg |
| 22 | jacking structure |
| 23 | deck |
| 24 | truss |
| 25 | piping system |
| 26 | fitting |

-continued

| PART NUMBER | DESCRIPTION |
|---|---|
| 27 | flexible hose |
| 28 | upper tray |
| 29 | piping system |
| 30 | fitting |
| 31 | flexible hose |
| 32 | coupling |
| 33 | foot |
| 34 | foot |
| 35 | vertical member |
| 36 | horizontal member |
| 37 | longitudinal member |
| 38 | gusset |
| 39 | diagonal member |
| 40 | lifting eye |
| 41 | opening |
| 42 | pipe spool piece |
| 43 | pipe spool piece |
| 44 | pipe spool piece |
| 45 | pipe rack |
| 46 | transverse member |
| 47 | vertical |
| 48 | pipe clamp |
| 49 | hose |
| 50 | lower tray |
| 51 | bottom |
| 52 | sidewall |
| 53 | bottom |
| 54 | sidewall |
| 55 | drain flow line |
| 56 | arrow |
| 57 | shackle |
| 58 | extension |
| 59 | rail |
| 60 | arrow |
| 61 | foot extension |
| 62 | second foot |
| 63 | lower horizontal beam |
| 64 | vertical beam |
| 65 | lower transverse beam |
| 66 | gusset plate |
| 67 | upper horizontal beam |
| 68 | upper transverse beam |
| 69 | guard rail |
| 70 | upper end portion |
| 71 | lower end portion |
| 72 | vertical member |
| 73 | upper horizontal member |
| 74 | lower horizontal member |

The foregoing embodiments are presented by way of example only; the scope of the present invention is to be limited only by the following claims.

What is claimed is:

1. A method of fluid transfer between a marine production platform and a work vessel wherein the platform or work vessel has a guard rail, comprising the steps of:

a) positioning the work vessel next to the production platform;

b) adjusting the elevational positions of the vessel relative to the production platform so that a deck portion of the production platform and a deck portion of the work vessel are at about the same elevation;

c) providing a bridge truss that enables a span to be formed between the deck portions of the production platform and work vessel, wherein the truss has an extension with a foot that fits under at least part of the guard rail, the bridge truss having interconnected truss members and a planar surface that enables flexible hoses to be supported by the truss and a plurality of piping spool pieces with disconnectable fittings;

d) spanning the gap between the marine production platform and the work vessel with the truss; and e) attaching piping systems on the production platform and work vessel to the spool pieces at the disconnectable fittings so that fluid transfer is enabled between the production platform and the work vessel via the spool pieces on the truss.

2. The method of claim 1 wherein in step "b" the work vessel is a jack up barge that is elevated until the deck of the jack up barge is at about the same elevation as the deck of the production platform.

3. The method of claim 1 wherein in step "c" some of the plurality of spool pieces are supported upon the truss at different elevational positions.

4. The method of claim 1 wherein the bridge truss includes an elongated tray that is connected to the bottom of the truss, and further comprising the step of preventing the escape of leaking fluids to the surrounding environment by catching such leaking fluids with the tray.

5. The method of claim 4 wherein there are two trays connected to the truss, one tray that catches leaking fluids and another tray that holds flexible hoses that span between the production platform and the work vessel via the truss.

6. The method of claim 1 wherein the truss does not have a walkway that allows personnel to travel between the production platform and the work vessel via the truss.

7. The method of claim 4 wherein the truss does not have a walkway that allows personnel to travel between the production platform and the work vessel via the truss.

8. The method of claim 5 wherein the truss does not have a walkway that allows personnel to travel between the production platform and the work vessel via the truss.

9. The method of claim 1 wherein the truss defines a liftable structure that is self supporting and that can be lifted with a crane, said liftable structure including said spool pieces and at least one tray.

10. A method of fluid transfer between a marine production platform having a deck and a work vessel having a deck, wherein the platform or work vessel has a periphery with a horizontally extending portion above deck, comprising the steps of:

a) positioning the work vessel next to the production platform;

b) adjusting the elevational positions of the vessel relative to the production platform so that a deck portion of the production platform and a deck portion of the work vessel are at about the same elevation;

c) providing a bridge truss that enables a span to be formed between the deck portions of the production platform and work vessel, wherein the truss has an extension with a foot that fits under at least part of the guard rail, the bridge truss having interconnected truss members and a planar surface that enables fluid conveying members to be temporarily supported by the truss and a plurality of pipe spool pieces with disconnectable fittings;

d) wherein in step "c" the bridge truss is a self supporting liftable structure that includes interconnected vertical, horizontal and diagonal members, an upper tray, a lower tray and a plurality of flow line spool pieces that each have end portions with piping connecting fittings;

e) connecting the production platform piping system to one or more of the flow line spool pieces with adjustable length temporary flexible flow lines that connect to the spool pieces at the piping connecting fittings;

f) transferring fluids between the production platform and work vessel via the spool piece flow lines and temporary flexible flow lines; and g) placing one or more flexible hoses on the truss above one of the trays.

11. The method of claim 10 wherein there are a plurality of spool piece flow lines supported at different elevations on the truss.

12. The method of claim 10 wherein some of the spool pieces are supported at the same elevation on the truss.

13. The method of claim 10 wherein the truss has feet at its opposite end portions.

14. The method of claim 10 wherein the flexible hoses are supported by one or both of the trays.

15. The method of claim 10 wherein there are two trays, each extending substantially the full length of the truss.

16. The method of claim 15 wherein one of the trays is walled and further comprising the step of retaining leakage from the spool pieces and temporary flow lines with the walled tray.

17. The method of claim 16 wherein the walled tray is a lower tray.

18. The method of claim 14 wherein one of the trays is an upper tray positioned above at least some of the spool pieces and one or more hoses is supported on the upper tray.

19. The method of claim 10 wherein the truss does not includes a walkway for enabling a worker to travel on foot between the production platform and the work vessel.

20. A method of fluid transfer between a marine production platform and a work vessel comprising the steps of:

a) positioning the work vessel next to the production platform;

b) adjusting the elevational positions of the vessel relative to the production platform so that a deck portion of the production platform and a deck portion of the work vessel are at about the same elevation;

c) providing a bridge truss that enables a span to be formed between the deck portions of the production platform and work vessel, the bridge truss having a length, a height, end portions, interconnected truss members, and a planar surface that enables flexible hoses to be supported by the truss, and a plurality of pipe spool pieces with disconnectable fittings;

d) wherein in step "c" the bridge truss is a self supporting liftable structure that includes interconnected vertical, horizontal and diagonal members, an upper tray, a lower tray and a plurality of flow line spool pieces that each have end portions with piping connecting fittings;

e) connecting the production platform piping system to one or more of the flow line spool pieces with adjustable length temporary flexible flow lines that connect to the spool pieces at the piping connecting fittings;

f) transferring fluids between the production platform and work vessel via the spool piece flow lines and temporary flexible flow lines; and g) wherein the truss has a foot extension on at least one of its end portions that is shorter than the truss height.

21. The method of claim 20 wherein there are a plurality of spool piece flow lines supported at different elevations on the truss.

22. The method of claim 20 wherein some of the spool pieces are supported at the same elevation on the truss.

23. The method of claim 20 wherein the truss has feet at its opposite end portions.

24. The method of claim 20 wherein the flexible hoses are supported by one or both of the trays.

25. The method of claim 20 wherein there are two trays, each extending substantially the full length of the truss.

26. The method of claim 25 wherein one of the trays is walled and further comprising the step of retaining leakage from the spool pieces and temporary flow lines with the walled tray.

27. The method of claim 26 wherein the walled tray is a lower tray.

28. The method of claim 24 wherein one of the trays is an upper tray positioned above at least some of the spool pieces and one or more hoses is supported on the upper tray.

29. A fluid transfer system for effecting fluid transfer between a production platform having a deck and a piping system, and a work vessel that is next to the production platform and having a deck and a piping system, comprising:

a) a bridge truss that is sized and shaped to span between the production platform and the work vessel, the truss having a length, a height, end portions, and a foot on each end portion;

b) upper and lower trays on the truss that each extend a majority of the length of the truss;

c) a plurality of pipe spool pieces on the truss, positioned in between the upper and lower trays;

d) connectors on the spool pieces for connecting each spool piece to the piping systems; and e) wherein at least one end portion of the truss has a foot extension on at least one end portion that is shorter than the truss height.

30. A method of fluid transfer between a marine platform having a piping system and a work vessel having a piping system comprising the steps of:

a) positioning the work vessel next to the platform;

b) adjusting the elevation of the vessel relative to the platform so that a deck portion of the platform and a deck portion of the work vessel are at about the same elevation;

c) providing a bridge that enables a span to be formed between the deck portions of the platform and work vessel, the bridge having a plurality of piping spool pieces with disconnectable fittings;

d) spanning the gap between the marine platform and the work vessel with the bridge; and e) attaching piping systems on the platform and work vessel to the spool pieces at the disconnectable fittings so that fluid transfer is enabled between the platform and the work vessel via the spool pieces on the bridge.

31. The method of claim 30 wherein in step "b" the work vessel is a jack up barge that is elevated until the deck of the jack up barge is at about the same elevation as the deck of the platform.

32. The method of claim 30 wherein in step "c" some of the plurality of spool pieces are supported upon the bridge at different elevations.

33. The method of claim 30 wherein the bridge supports an elongated tray that is connected to the bottom of the bridge, and further comprising the step of preventing the escape of leaking fluids to the surrounding environment by catching such leaking fluids with the tray.

34. The method of claim 33 wherein there are two trays connected to the bridge, one tray that catches leaking fluids and another tray that holds flexible hoses that span between the platform and the work vessel via the bridge.

35. The method of claim 30 wherein the bridge does not have a walkway that allows personnel to travel between the platform and the work vessel via the bridge.

36. The method of claim 33 wherein the bridge does not have a walkway that allows personnel to travel between the platform and the work vessel via the bridge.

37. The method of claim 34 wherein the bridge does not have a walkway that allows personnel to travel between the platform and the work vessel via the bridge.

38. The method of claim 30 wherein the bridge defines a liftable structure that is self supporting and that can be lifted with a crane, said liftable structure including said spool pieces and at least one tray.

39. A method of fluid transfer between a marine production platform having a deck and a work vessel having a deck, the platform and work vessel each having piping systems, comprising the steps of:

a) positioning the work vessel next to the production platform;

b) adjusting the elevation of the vessel relative to the production platform so that a deck portion of the production platform approaches a deck portion of the work vessel;

c) providing a bridge that enables a span to be formed between the deck portions of the production platform and work vessel, the bridge having a plurality of pipe spool pieces with disconnectable fittings;

d) wherein in step "c" the bridge is a self supporting liftable structure;

e) connecting the production platform piping system to one or more of the flow line spool pieces with adjustable length temporary flexible flow lines that connect to the spool pieces at the piping connecting fittings; and f) transferring fluids between the production platform and work vessel via the spool piece flow lines.

40. The method of claim 39 wherein there are a plurality of spool piece flow lines supported at different elevations on the bridge.

41. The method of claim 39 wherein some of the spool pieces are supported at the same elevation on the bridge.

42. The method of claim 39 wherein the bridge has feet at its opposite end portions.

43. The method of claim 39 wherein the bridge has one or more trays and the flexible hoses are supported by a tray.

44. The method of claim 43 wherein there are two trays, each extending substantially the full length of the bridge.

45. The method of claim 44 wherein one of the trays is walled and further comprising the step of retaining leakage from the spool pieces and temporary flow lines with the walled tray.

46. The method of claim 45 wherein the walled tray is a lower tray.

47. The method of claim 43 wherein one of the trays is an upper tray positioned above at least some of the spool pieces and one or more hoses is supported on the upper tray.

48. The method of claim 39 wherein the bridge does not includes a walkway for enabling a worker to travel on foot between the production platform and the work vessel.

* * * * *